United States Patent [19]

Morikawa

[11] Patent Number: 4,942,859

[45] Date of Patent: Jul. 24, 1990

[54] SAFETY SYSTEM FOR AN AUTOMOTIVE ENGINE

[75] Inventor: Koji Morikawa, Tokyo, Japan

[73] Assignee: Fuji Jukogyo Kabushiki Kaisha, Tokyo, Japan

[21] Appl. No.: 344,271

[22] Filed: Apr. 27, 1989

[30] Foreign Application Priority Data

Apr. 30, 1988 [JP] Japan ..... 63-059606[U]

[51] Int. Cl.[5] ..... F02B 77/00

[52] U.S. Cl. ..... 123/198 D; 123/351

[58] Field of Search .... 123/198 D, 198 DB, 198 DC, 123/351

[56] References Cited

U.S. PATENT DOCUMENTS 4,574,752 3/1986 Reichert, Jr. et al. ..... 123/198 DB 4,621,600 11/1986 Hasegawa ..... 123/198 D 4,729,357 3/1988 Freudenschuss et al. ..... 123/198 D 4,811,808 3/1989 Matsumoto et al. ..... 123/198 DB

FOREIGN PATENT DOCUMENTS 61-8435 1/1986 Japan .

*Primary Examiner*—Noah P. Kamen

*Attorney, Agent, or Firm*—Martin A. Farber

[57] ABSTRACT

An accelerator sensor is provided for detecting the degree of depression of an accelerator depression pedal of a vehicle. A torque sensor is provided for detecting the output torque of the transmission. The torque detected by the torque sensor is compared with a predetermined value. When the detected torque is larger than the predetermined value, an engine stop signal is produced, thereby stopping operation of the engine.

2 Claims, 3 Drawing Sheets

SAFETY SYSTEM FOR AN AUTOMOTIVE ENGINE

BACKGROUND OF THE INVENTION

The present invention relates to a safety system for detecting abnormality in a control system of an automotive engine and for stopping the engine.

Japanese Patent Application No. Laid-Open 61-8435 discloses an abnormality detecting system where a throttle position detecting means is provided for detecting the degree of of a throttle valve and an accelerator pedal position sensor is provided for producing an accelerator pedal depression signal dependent on the degree of depression of the accelerator pedal. When the throttle position detecting means produces an output signal representing an opening of the throttle valve while the accelerator pedal depression signal is zero, the system determines that the throttle position detecting means broke down.

However, in an engine control system where a throttle valve is driven by a stepper motor in accordance with the depression degree of the accelerator pedal, such an abnormality detecting system is improper. If an operating system for the stepper motor breaks down, the throttle valve can not be controlled. It causes a dangerous situation such that engine speed extremely increases.

SUMMARY OF THE INVENTION

The object of the present invention is to provide a safety system for an automotive engine which detects abnormality in relation to depression degree of an accelerator pedal and an output torque of the engine, thereby avoiding dangerous driving conditions of a motor vehicle.

According to the present invention, there is provided a safety system for an automotive engine for a motor vehicle having an accelerator pedal for controlling a throttle valve of the engine and a transmission for transmitting power from the engine to the wheels of the vehicle, comprising an accelerator pedal depression sensor for detecting release of the accelerator pedal and for producing a release signal, a torque sensor for detecting output torque of the transmission and for producing a torque signal representing the detected torque, comparator means responsive to the release signal for comparing the detected torque represented by the torque signal with a predetermined value and for producing an abnormality signal when the detected torque is larger than the predetermined value, and stopping means responsive to the abnormality signal for stopping operation of the engine.

In an aspect of the invention, the system further comprises an engine speed sensor for detecting speed of the engine and for producing an engine, speed signal, the accelerator pedal sensor for producing a position signal dependent on depression degree of the accelerator pedal and an actuator responsive to the position signal and the engine speed signal for operating the throttle valve.

The other objects and features of this invention will become understood from the following description with reference to the accompanying drawings.

DETAILED DESCRIPTION OF THE PREFERRED EMBODIMENT

Figure 1:
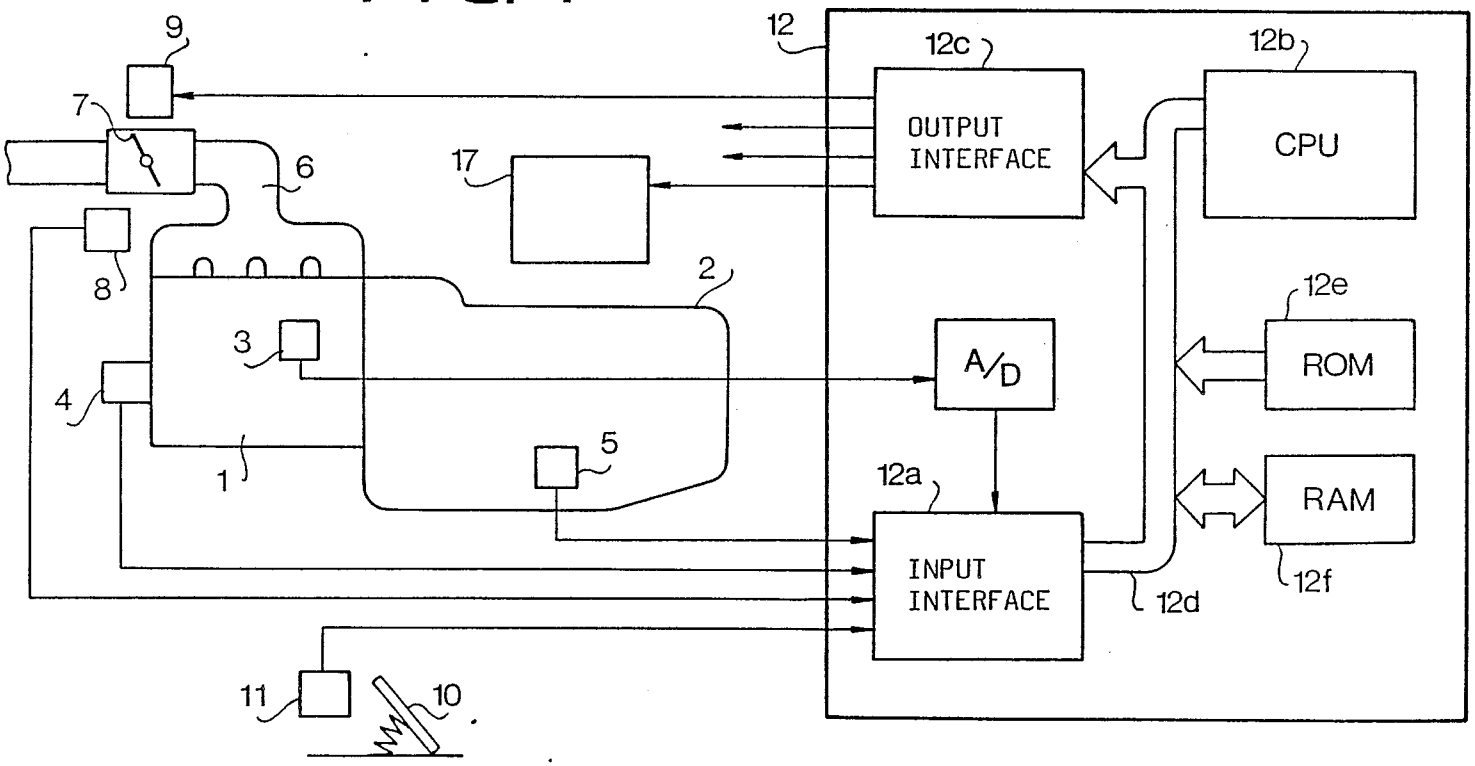
FIG. 1 is a schematic diagram showing a system to which the present invention is applied.

Referring to FIG. 1, an engine 1 for a motor vehicle is provided with a coolant temperature sensor 3 and an engine speed sensor (a crank angle sensor) 4. Power of the engine 1 is transmitted to driving wheels through a transmission 2, on which a torque sensor 5 is provided. An intake passage 6 of the engine 1 has a throttle valve 7 and a throttle position sensor 8 is provided on the throttle valve 7. The throttle valve 7 is operated by a throttle actuator 9 such as a stepper motor. An accelerator depression sensor 11 is provided for sensing of degree of depression of an accelerator pedal 10.

When the accelerator pedal 10 is depressed, the accelerator depression sensor 11 produces a position signal, dependent on the depression degree of the accelerator pedal which is applied to a control unit 12. Dependent on the signal, the control unit 12 supplies a driving signal to the throttle actuator 9.

The control unit 12 comprises an input interface 12*a* applied with signals from the engine speed sensor 4, the torque sensor 5, the throttle position sensor 8 and the accelerator sensor 11. A signal from the coolant temperature sensor 3 is supplied to the input interface 12*a* through an A/D converter. A CPU 12*b* processes these input signals and produces output signals through an output interface 12*c*. For example, output signals are applied to the throttle actuator 9 and a distributor 17 of an ignition system. The input interface 12*a* , CPU 12*b* , output interface 12*c*, ROM 12*e*, and RAM 12*f* are connected to each other through a bus line 12*d*.

Figure 2:
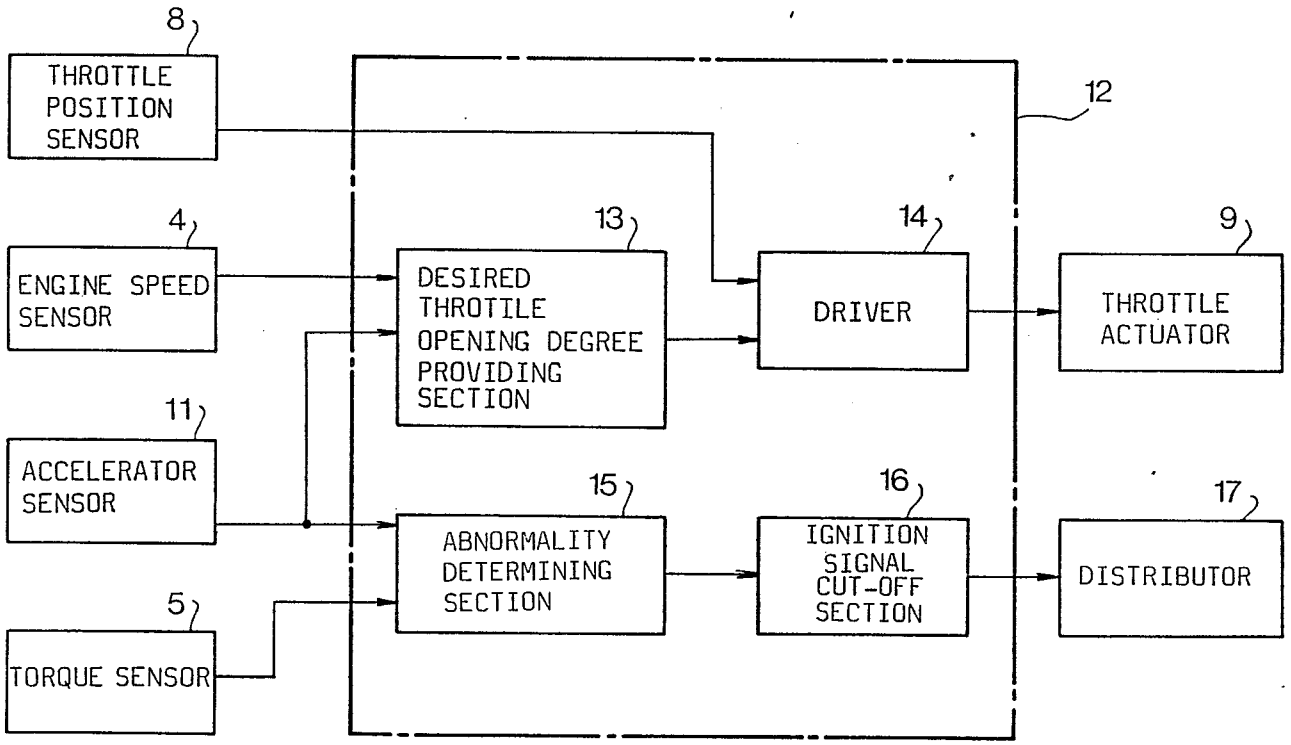
FIG. 2 is a block diagram of a control unit of the system.

Referring to FIG. 2 showing a block diagram of the control unit 12 for detecting abnormality of the control system for the engine, the output signals from the engine speed sensor 4 and the accelerator depression sensor 11 are applied to a desired throttle valve opening degree providing section 13. The desired throttle opening degree providing section 13 derives a desired degree of opening of the throttle valve 7 in accordance with these signals from a map stored in the ROM 12*e*. A driver 14 compares the desired throttle opening degree and the actual throttle opening degree detected from the throttle position sensor 8 and produces an actuating signal for actuating the throttle actuator 9. Thus, the throttle valve is controlled to the desired throttle opening degree.

The coolant temperature from the coolant temperature sensor 3 can be supplied to the driver 14 for increasing the accuracy of the control.

Further, the output signal from the accelerator depression sensor 11 and the actual torque signal from the torque sensor 5 are applied to an abnormality determining section 15. In the normal state, when the accelerator pedal 10 is released to close the throttle valve 7, the output of the torque sensor 5 goes to minimum value. However, when the throttle, valve control system comprising means 13 and 14 and the actuator 9 breaks down or is in an abnormal state, the throttle valve 7 is not closed so that the output of the torque sensor 5 does not go to the minimum value. In the system, when the depression degree of the accelerator pedal is zero a release signal is produced by the sensor 11 and the output torque produced after a predetermined time lag has a value larger than a predetermined minimum value, the abnormality determining section 15 produces an abnormality signal. In this case, the predetermined value is zero, i.e., the abnormality signal is produced whenever the output torque becomes positive. The abnormality signal is applied to an ignition signal cut-off section 12 which operates to stop supplying an ignition signal to the distributor 17 of the ignition system, thereby stopping the engine.

Figure 3:
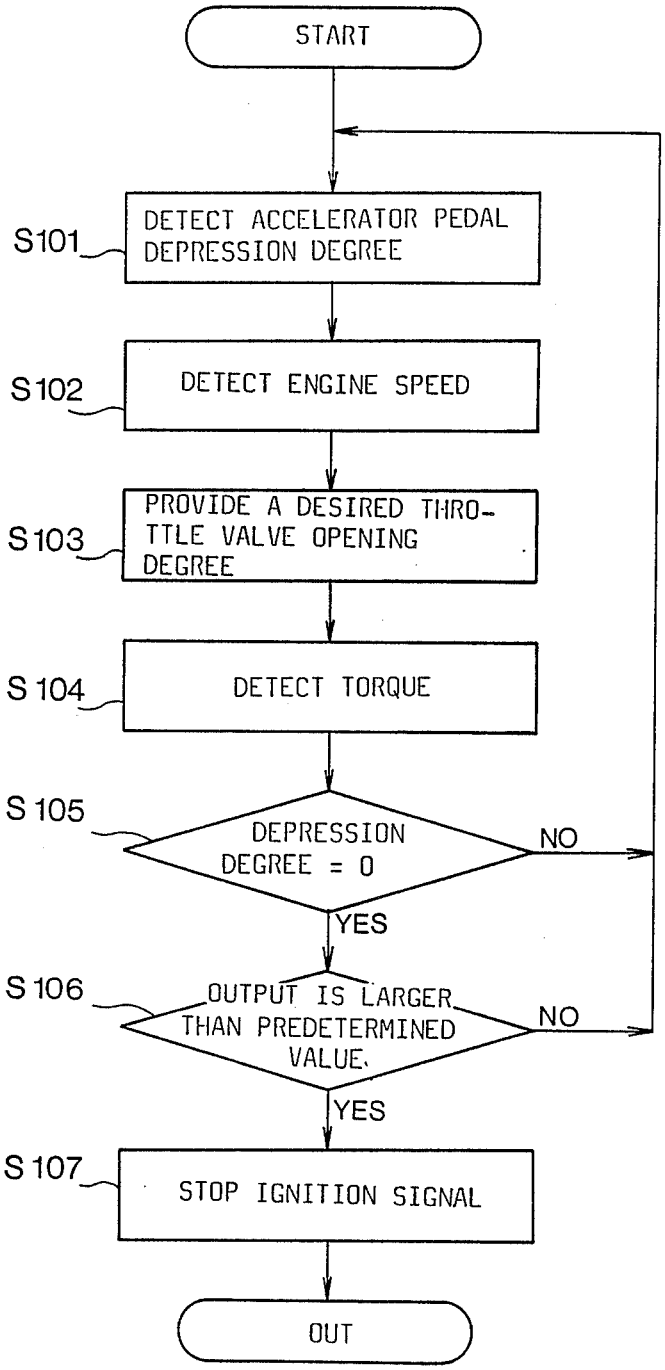
FIG. 3 is a flowchart showing operation of the present invention.

FIG. 3 shows the operation of the control unit 12 for a safety control.

At a step S101, the depression degree of the accelerator pedal 7 is fetched from the accelerator depression sensor 11. At a step S102, the engine speed is detected by the engine speed sensor 4. At a step S103, a desired opening degree of the throttle valve is provided in accordance with the detected throttle valve opening degree and the engine speed with reference to a map. At a step S104, the actual torque is detected by the torque sensor 5. At a step S105, it is determined whether the depression degree of the accelerator pedal 7 is zero or not. If the depression degree is zero, the program goes to a step S106. Unless the depression degree is zero, the program returns to the step S101. At step S106, it is determined whether the output detected after the predetermined time lag is larger than the predetermined minimum value or not. If the output is larger than the predetermined value, the program proceeds to a step S107 where the ignition signal is cut off to stop the engine. Unless the output is positive at step S106, the program returns to step S101.

In accordance with the present invention, abnormality is detected in relation to the depression degree of the accelerator pedal and the output torque of the transmission, for stopping the engine. Accordingly, if the control system for the throttle valve is in an abnormal state, extreme increase of the engine speed or vehicle speed can be prevented.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A safety sytem for an automotive engine of a motor vehicle having an accelerator pedal for controlling a throttle valve of the engine and a transmission for transmitting power of the engine to wheels of the vehicle, comprising:

an accelerator pedal sensor for detecting release of the accelerator pedal and for producing a release signal;

a torque sensor for detecting output torque of the transmission and for producing a torque signal representing the detected torque;

comparator means responsive to the release signal for comparing the detected torque represented by the torque signal with a predetermined value and for producing an abnormality signal when the detected torque is larger than the predetermined value; and stopping means responsive to the abnormality signal for stopping operation of the engine.

2. The system according to claim 1, further comprising an engine speed sensor for detecting speed of the engine and for producing an engine speed signal, said accelerator pedal sensor producing a position signal dependent on depression degree of the accelerator pedal, and an actuator responsive to the position signal and the engine speed signal for operating the throttle valve.

* * * * *